US005635464A

United States Patent [19]

Nakamura et al.

[11] Patent Number: 5,635,464

[45] Date of Patent: Jun. 3, 1997

[54] AQUEOUS HARD SURFACE DETERGENT COMPOSITIONS CONTAINING CALCIUM IONS

[75] Inventors: Yuko (Okabe) Nakamura, Kobe; Mayumi Daiki, Kyoto; Ryohei Ohtani, Ibaraki, all of Japan

[73] Assignee: The Procter & Gamble Company, Cincinnati, Ohio

[21] Appl. No.: 290,711

[22] PCT Filed: Feb. 8, 1993

[86] PCT No.: PCT/US93/01156

§ 371 Date: Nov. 17, 1994

§ 102(e) Date: Nov. 17, 1994

[87] PCT Pub. No.: WO93/17084

PCT Pub. Date: Sep. 2, 1993

[30] Foreign Application Priority Data

Feb. 19, 1992 [JP] Japan ..... H4-069607
Mar. 30, 1992 [JP] Japan ..... H4-074509

[51] Int. Cl.[6] ..... C11D 1/29; C11D 1/75; C11D 1/83; C11D 3/02

[52] U.S. Cl. ..... 510/237; 510/218; 510/235; 510/427; 510/428; 510/433; 510/495; 510/502; 510/503; 510/506

[58] Field of Search ..... 252/551, 547, 252/546, DIG. 14; 510/237, 218, 235, 427, 428, 433, 495, 502, 503, 506

[56] References Cited

U.S. PATENT DOCUMENTS

| | | | |
|---|---|---|---|
| 4,111,855 | 9/1978 | Barrat et al. | 252/545 |
| 4,133,779 | 1/1979 | Hellyer et al. | 252/547 |
| 4,318,818 | 3/1982 | Letton | 252/174.12 |
| 4,381,247 | 4/1983 | Nakagawa et al. | 252/95 |
| 4,904,359 | 2/1990 | Pancheri et al. | 252/548 |
| 5,013,485 | 5/1991 | Tsukuda et al. | 252/551 |
| 5,030,378 | 7/1991 | Venegas | 252/174.12 |
| 5,188,769 | 2/1993 | Connor et al. | 252/548 |
| 5,221,495 | 6/1993 | Cao | 252/135 |
| 5,269,974 | 12/1993 | Ofosu-Asante | 252/544 |
| 5,378,409 | 1/1995 | Ofosu-Asante | 252/548 |
| 5,415,801 | 5/1995 | Ofosu-Asante | 252/174.17 |
| 5,415,814 | 5/1995 | Ofosu-Asante | 252/558 |
| 5,417,893 | 5/1995 | Ofosu-Asante | 252/558 |

FOREIGN PATENT DOCUMENTS 28866 5/1981 European Pat. Off. .

*Primary Examiner*—Michael Tierney
*Attorney, Agent, or Firm*—Robert B. Aylor; T. David Reed

[57] ABSTRACT

An aqueous hard surface detergent composition which provides improved solution feel comprising 3–35% of a surfactant system selected from the group consisting of anionic, nonionic, amphoteric surfactants and mixtures thereof and 0.01–0.5% by weight calcium ion and optionally 0.1–1% magnesium ion.

2 Claims, No Drawings

AQUEOUS HARD SURFACE DETERGENT COMPOSITIONS CONTAINING CALCIUM IONS

TECHNICAL FIELD

The present invention relates to an aqueous hard surface detergent composition containing calcium ion which provides improved solution feel without deteriorating storage stability of the composition. The composition is particularly useful for dishwashing liquids, more particularly under soft water conditions.

BACKGROUND

Anionic surfactants such as alkyl ethoxy sulfates with short ethylene oxide chains, alkyl sulfates, alkyl benzene sulfonates, a-olefin sulfonates, and alkyl ethoxy carboxylates are known to be very effective for hard surface cleaning, but are also known to have more or less unfavorable "slippery" feel in use. This undesirable attribute is a problem to hard surface cleaning compositions, especially for dishwashing purposes.

There is therefore a considerable demand for a hard surface detergent composition which has good detergency and good storage stability while having good solution feel when cleaning and rinsing, particularly for dishwashing purposes. As defined herein, good solution feel is best defined as the absence of "slippery" or "slimy" feel, or a "draggy" kind of feel which one feels when the composition is in use. "Good solution feel" is an important attribute for commercial liquid detergent products. Those wash solutions which have good solution feel on hands and objects to be cleaned allow easy handling of the objects, and provide good rinsing characters. Such benefits are most appreciated for dishwashing purposes.

Many attempts have been made to improve solution feel using various technology. These attempts are usually directed towards the use of nonionic-type surfactants, and other suds enhancing-type and solvent-type components. Generally, these compositions have sacrificed detergency to obtain the improved solution feel.

Kokoku 46-43550 (Kao Corporation) teaches a liquid detergent composition which is mild to skin and has good detergency comprising alkaline earth metal salts of certain alkyl alkylene-oxy sulfate and certain alkyl alkylene-oxy carboxylates.

Kokai 51-125405 (The Procter & Gamble Company) teaches compositions comprising calcium and magnesium salts of anionic surfactants including alkyl ether sulfates and amine oxides, $C_{1-5}$ alkanols and water, wherein the weight ratio of amine oxide to anionic surfactant is 1:100 to 1:2. Up to about 25% of the anionic surfactants can be monovalent salts.

U.S. Pat. No. 2,766,212 (General Aniline and Film Corporation) teaches compositions which comprise alkyl ether alkoxy sulfate salts and water soluble polyvalent salts of magnesium, calcium, iron, or aluminum of 5–50% by weight of the surfactant. Examples show compositions comprising at least 70% of the anionic surfactant in which magnesium and calcium ions help detergency.

U.S. Pat. No. 4,681,704 (The Procter & Gamble Company) teaches a detergent composition with effective grease removal comprising 10–50% alkaline earth metal salt, preferably magnesium, of anionic surfactants, 0.5–10% amine oxides, and 0.5–15% betaines.

However, the above mentioned disclosures use alkaline earth metals mainly for their cleaning benefits, and do not disclose or suggest the improvement to solution feel benefits contributed by calcium ions. Further, the compositions of the above mentioned disclosures have high divalent ion levels, so that they would be unstable upon storage in the context of the present invention, namely, would form undesirable precipitates of calcium. Preferred compositions and examples shown in the above disclosures also have high surfactant levels, and thus the amount of calcium needed to reduce or eliminate the "slippery feel" of the composition would place the composition into a phase where calcium is believed to easily precipitate.

Here, it has been found that by using calcium ions at a certain low level, a composition which provides improved solution feel without deteriorating storage stability is obtained.

OBJECT OF INVENTION

It is an object of the present invention to provide a clear aqueous hard surface detergent composition which has improved solution feel in use without deteriorating storage stability of the composition.

It is also an object of the present invention to provide a liquid hard surface detergent composition which has balanced good quality in detergency, solution feel, and storage stability.

It is further an object of the present invention to provide a method of improving the solution feel of an aqueous hard surface detergent composition or a wash solution of an aqueous hard surface detergent composition by adding calcium ion to said composition.

DETAIL DESCRIPTION

The present invention relates to an aqueous hard surface detergent composition which provides improved solution feel comprising:

(1) 3–35% by weight of a surfactant system selected from the group consisting of anionic, nonionic, amphoteric surfactants, and mixtures thereof, comprising:

a. at least 3% by weight of the composition and at least 20% by weight of the surfactant system alkyl ethoxy sulfate with an alkyl group of $C_{10-16}$ and an average of 1–10 moles of ethylene oxide per molecule;

b. other anionic surfactants selected from the group consisting of alkyl benzene sulfonates, a-olefin sulfonates, alkyl ethoxy carboxylates , and mixtures thereof;

c. 0–9% by weight of the composition diethanol amide with an alkyl chain of $C_{8-20}$;

d. 0–10% by weight of the composition amine oxide with an alkyl chain of $C_{8-16}$; and (2) 0.01–0.5% by weight calcium ion;

wherein at least 20% by weight of the surfactant system comprises the total of component a, b, c, and d.

The present invention also relates to a method of improving the solution feel of an aqueous hard surface detergent composition or a wash solution of an aqueous hard surface detergent composition by adding calcium ion to said composition.

The composition has less of an unacceptable slippery feel, and is easy to handle when cleaning and rinsing. The compositions of the present invention have good storage stability, that is, the composition is stable in ordinary use conditions, more specifically, it does not generate precipitation or gel in the temperature range of from −5° C. to 40° C.

Anionic Surfactant

The compositions of the present invention comprise 15–35%, preferably 20–30% by weight surfactant system selected from the group consisting of anionic, nonionic, amphoteric surfactants, and mixtures thereof. At least 20%, preferably at least 40%, more preferably at least 60%, by weight of the surfactant system is the sum of anionic surfactants, diethanol amide, and amine oxide. Among the anionic surfactants, at least 3%, preferably at least 8%, more preferably at least 12%, of the composition is alkyl ethoxy sulfate with an alkyl group of $C_{10-16}$ and an average of 1–10 moles, more preferably 2–5 moles, of ethylene oxide per molecule.

The anionic surfactants are selected from said alkyl ethoxy sulfates, alkyl sulfates, alkyl benzene sulfonates, a-olefin sulfonates, alkyl ethoxy carboxylates, and mixtures thereof.

Alkyl ethoxy sulfate, particularly having an alkyl group of $C_{10-16}$ and an average of 1–10 moles, preferably 2–5 moles, more preferably 2.5–3.5 moles, of ethylene oxide per molecule, provides good detergency and less negative effect on solution feel. Furthermore, compositions including a considerable amount of such alkyl ethoxy sulfates are susceptible to the effect of improved solution feel due to calcium ions. The average number of moles of ethylene oxide per molecule of the alkyl ethoxy sulfates can change the character of the surfactant. Here, alkyl sulfate is dealt as an alkyl ethoxy sulfate having 0 moles of ethylene oxide per molecule. Generally, it is known that the longer the ethylene oxide chain contribute less to poor solution feel, but have poorer detergency performance. Those which have less than an average ethylene oxide chain of 1 moles per molecule by themselves will contribute to poor solution feel.

The salts for the anionic surfactant component can be alkali metal, alkali earth metal, amines, or ammonium salts, preferably sodium or ammonium salts. Alkali earth metal salts of these surfactants are known for good detergency and sudsing. Some or all of the calcium ion of the present composition can be introduced as calcium salts of the anionic surfactant.

Other Surfactants

The compositions of the present invention comprise, for the balance of the surfactant system, other anionic surfactants, nonionic surfactant and amphoteric surfactants. These surfactants are formulated in the compositions of the present invention to enhance detergency, and to enhance and stabilize suds. The species and levels of the other anionic, nonionic and amphoteric surfactants are chosen in order to obtain optimum balance of detergency, solution feel, and storage stability.

The compositions of the present invention can contain nonionic surfactants such as diethanol amides and amine oxides. 0–9%, preferably 4–7% by weight of diethanol amide and 0–10% preferably 2–5% by weight of amine oxide is contained in the composition. These two surfactants are known to provide good detergency and good storage stability, but can negatively effect solution feel. The use of calcium ion to improve solution feel is particularly useful in composition comprising diethanol amide and/or amine oxide.

Diethanol amide useful in the present invention has the formula

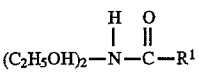

I wherein $R^1$ is selected from an alkyl chain of $C_{8-20}$, preferably $C_{12-14}$.

Amine oxide useful in the present invention has the formula

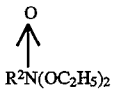

II wherein $R^2$, is selected from an alkyl chain of $C_{8-20}$, preferably $C_{12-14}$.

Calcium

It has been found that by incorporating low levels of calcium ions, balanced benefits in solution feel and storage stability are obtained. The effect of the addition of low levels of calcium ion into dishwashing compositions is particularly beneficial under low hardness water conditions, where the amount of calcium introduced from tap water is low.

Calcium ions are added to the composition at levels of 0.01–0.5%, preferably 0.1–0.5%, most preferably 0.1–0.3%. At lower calcium levels, no effect on solution feel will be observed. At higher calcium levels, storage stability will not be good. That is, it is known that calcium ions are relatively easily precipitated at high temperature conditions, and thus are apt to deteriorate storage stability when added at high levels. Calcium ions are further known to contribute to detergency, particularly to grease removal. By selecting a calcium level in the above range, a composition having all three important benefits are obtained; good solution feel, good grease removal, and good storage stability.

The compositions of the present invention must have less than 35% total surfactants to avoid precipitation of the calcium which is present at a level sufficient to improve solution feel. If the surfactant level is too high, the maximum amount of calcium that can be added without forming calcium precipitation would not be sufficient to improve solution feel to the composition.

The calcium ions can be incorporated in the composition in any convenient way, so long as the salts containing calcium ions are soluble in water and do not precipitate under ordinary use conditions. A suitable way of incorporating calcium ions is by adding them as salts selected from the group consisting of chloride, hydroxide, oxide, acetate, nitrate, formate, and mixtures thereof. Chloride salts are most preferred.

Alternately, calcium ions can also be incorporated as counter-ions of anionic surfactants, such as by neutralizing the acid form of anionic surfactants with calcium oxide or calcium hydroxide, without affecting the benefits thereof.

The preferred composition of the present invention comprises:

(1) 20–30% by weight of a surfactant system selected from the group consisting of anionic, nonionic, amphoteric surfactants, and mixtures thereof, comprising:
   a. at least 35% by weight of the surfactant system alkyl ethoxy sulfate with an alkyl group of $C_{10-16}$ and an average of 2.5–3.5 ethylene oxide per molecule;
   b. 4–7% by weight of the composition diethanol amide with an alkyl chain of $C_{8-20}$;
   c. 2–5 by weight of the composition amine oxide with an alkyl chain of $C_{8-16}$;

(2) 0.1–0.3% by weight calcium ion; and (3) 0.1–1% by weight magnesium ion.

Optional Components

The compositions of the present invention can optionally contain components in addition to those already disclosed herein.

Optional surfactants useful in the composition of the present invention are those such as monoethanol amides, polyhydroxy fatty acid amides, alkyl polyglucosides, and alkyl ethoxylates.

Monoethanol amide is an optional surfactant in the present invention, having the formula

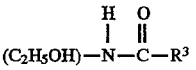

wherein $R^3$ is selected from an alkyl chain of $C_{8-20}$, preferably $C_{12-14}$.

Polyhydroxy fatty acid amide is an optional surfactant in the present invention, having the formula

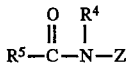

wherein $R^4$ is H, $C_{1-4}$ hydrocarbyl, 2-hydroxy ethyl, 2-hydroxy propyl, or a mixture thereof, preferably $C_{1-4}$ alkyl, more preferably methyl; and $R^5$ is $C_{5-31}$ hydrocarbyl, preferably straight-chain $C_{10-16}$ alkyl; and Z is polyhydroxyhydrocarbyl having a linear hydrocarbyl chain with at least 3 hydroxyls directly connected to the chain, or an alkoxylated derivative (preferably ethoxylated or propoxylated) thereof Z preferably will be derived from a reducing sugar in a reductive amination reaction; more preferably Z is glycityl. Suitable reducing sugars include glucose, fructose, maltose, lactose, galactose, mannose, and xylose.

Alkyl polyglucoside is an optional surfactant in the present invention, having the formula $$R^6O(C_mH_{2m}O)_p(\text{glucosyl})_q$$

wherein $R^6$ is selected from the group consisting of alkyl, alkylphenyl, hydroxyalkyl, hydroxyalkylphenyl, and mixtures thereof in which the alkyl groups are $C_{10-18}$, preferably $C_{12-14}$, m is 2 or 3, preferably 2; p is from 0 to about 10, preferably 0; and q is 1.3–10, preferably 1.3–3, most preferably 1.3–2.7. To prepare these compounds the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4-and/or 6-position, preferably predominately the 2-position.

Alkyl ethoxylate is an optional surfactant in the present invention. Such alkyl ethoxylates are aliphatic alcohols with 1–25 moles of ethylene oxide. The alkyl chain of the aliphatic alcohol can either be straight or branched, primary or secondary, and generally contains 8–22 carbon atoms. Particularly preferred are the condensation products of alcohols having an alkyl group containing 8–20 carbon atoms with 2–10 moles of ethylene oxide per mole of alcohol. Most preferred are the condensation products of alcohols having an alkyl group containing 8–14 carbon atoms with 6–10 moles of ethylene oxide per mole of alcohol.

Amphoteric surfactants optionally included in the present invention are betaines having the formula

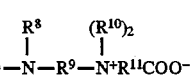

wherein $R^7$ is a $C_{7-21}$ alkyl group, or alkylaryl group, preferably $C_{9-17}$; $R^8$ is hydrogen or a $C_{1-6}$ alkyl group, preferably $C_{1-3}$; $R^9$ is a $C_{1-10}$ alkylene group, preferably $C_{2-6}$, most preferably $C_3$; each $R^{10}$ is a $C_{1-6}$ alkyl or hydroxy alkyl group, preferably $C_{1-3}$, most preferably methyl or an ethoxylated hydroxy alkyl containing from about 1 to about 10 ethylene oxide units; and $R^{11}$ is an $C_{1-6}$ alkylene group, preferably methyl.

Magnesium ions at a level of 0.1–1% are preferably included in the composition of the present invention to improve detergency without affecting good solution feel and good storage stability of the composition.

The compositions of the present invention can also comprise 4–8% by weight of a hydrotrope selected from the group consisting of sodium and ammonium salts of cumene sulfonates, toluene sulfonates, xylene sulfonates, sulfo succinates, and mixtures thereof. Such components are utilized in the interests of achieving a desired product phase stability and viscosity.

Other desirable ingredients include solvents, preservatives, dyes, and perfumes.

Solvents useful in the present invention include water and lower molecular weight alcohols, such as ethanol. Ethanol is also known to reduce the viscosity of the product, if necessary for formulation. Solvents other than water are typically present at levels of 2–10% by weight.

Preservatives, dyes, and perfumes can be, and usually will be formulated in the composition of the present invention to make products attractive to the consumer. These components are typically present at levels not more than 1% respectively.

Components which are preferably not included in the composition are those which generate precipitation upon binding with calcium ions. Examples are those which include sulfate, carboxylate, and fatty acid unions.

EXAMPLES

The following examples illustrate the compositions of the present invention, but are not intended to be limiting thereof. All percentages and ratios are based on weight unless otherwise specified.

Preparation

The liquid detergent compositions herein described can be made conveniently by one skilled in the art. Surfactants, hydrotropes, calcium salts, and optionally magnesium salts are added in an appropriate amount of water and are blended. In the present invention, the order of adding the components is not important. If necessary, the pH of the mixture is adjusted with HCl to a safe level for household products, and viscosity is adjusted with alcohol. Perfume, dye, and preservatives are optionally added, and the composition is balanced with water. The standard product and examples 1–9 are all prepared according to this method.

Experimentation

1. Solution feel 500g each of 6% solutions of the standard product and compositions of the present invention are prepared in a 1 liter beaker, and a porcelain crucible is soaked in the solution.

One hand is soaked in the sample solution and the other hand is soaked in the general standard product solution at the same time, and the feel of the crucible is evaluated according to the scale as shown below.

Evaluation is done by three special panelists, and the average score is obtained.

Evaluation scale

0=There is no difference

±1=I think there is a difference

±2=I know there is a difference

±4=I know there is a big difference

±4=I know there is a very big difference (+): the sample has a better feel (less slippery)

(–): the sample has a worse feel (more slippery)

For those which have higher points than the composition with the same surfactant system without calcium, it is evaluated that the "solution feel was improved".

2. Storage Stability

The sample is placed in a 100 ml glass container, and stored in rooms with established temperatures of –5° C. and 40° C. respectively. The condition of the product after 2 weeks is evaluated as follows.

clear and no change compared to before the test –O precipitated, or cloudy –X

According to Table 1, it is understood that Examples 1, 3, 4, and 7 which are compositions of the present invention have both improved solution feel and good storage stability.

TABLE 1

| | Standard product | 1 | 2 | 3 | 4 | 5 | 6 | 7 | 8 |
|---|---|---|---|---|---|---|---|---|---|
| Sodium $C_{12-14}$ alkyl ethoxy (5 ave.) sulfate | 11.7 | 11.7 | — | — | — | — | — | — | — |
| Ammonium $C_{12-14}$ alkyl ethoxy (3 ave.) sulfate | — | — | 12.0 | 12.0 | 12.0 | 12.0 | 12.0 | 12.0 | 12.0 |
| $C_{12-14}$ alkyl dimethyl amine oxide | 3.1 | 3.1 | 3.0 | 3.0 | 3.0 | 3.0 | 3.0 | 2.0 | 3.0 |
| $C_{12}$ alkyl diethanol amide | 4.4 | 4.4 | 4.5 | 4.5 | 4.5 | 4.5 | 4.5 | 4.5 | 4.5 |
| $C_{12-14}$ alkyl N-methyl glucoamide | — | — | 5.0 | 5.0 | 5.0 | 5.0 | — | — | — |
| $C_{12}$ alkyl ethoxy (3 ave.) alcohol | 2.3 | 2.3 | — | — | — | — | — | — | — |
| $C_{9-11}$ alkyl ethoxy (8 ave.) alcohol | — | — | 1.5 | 1.5 | 1.5 | 1.5 | 1.5 | 1.5 | 1.5 |
| Sodium toluene sulfonate | 2.3 | 2.3 | — | — | — | — | — | — | — |
| Sodium cumene sulfonate | — | — | 5.0 | 5.0 | 5.0 | 5.0 | 5.0 | 5.0 | 5.0 |
| $Mg^{++}(MgCl_2.7H_2O)$ | — | — | 0.7 | 0.5 | 0.36 | 0.1 | 0.7 | 0.5 | 0.1 |
| $Ca^{++}(CaCl_2)$ | — | 0.3 | — | 0.2 | 0.14 | 0.6 | — | 0.2 | 0.6 |
| Ethanol | 2.5 | 2.5 | 4.2 | 4.2 | 4.2 | 4.2 | 2.8 | 2.8 | 2.8 |
| Water and other minors | bal* | bal | bal | bal | bal | bal | bal | bal | bal |
| Solution feel(point) | Std | +2.0 | –1.38 | –0.88 | +0.75 | +0.75 | –1.38 | –0.5 | +0.13 |
| (comparison example) | — | Std | — | ex. 2 | ex. 2 | ex. 2 | — | ex. 6 | ex. 6 |
| (improved points) | — | +2.0 | — | +0.5 | +2.13 | +2.13 | — | +0.88 | +1.25 |
| (evaluation) | — | 0 | — | 0 | 0 | 0 | — | 0 | 0 |
| Storage stability | | | | | | | | | |
| (–5° C.) | 0 | 0 | 0 | 0 | 0 | X | 0 | 0 | X |
| (40° C.) | 0 | 0 | 0 | 0 | 0 | X | 0 | 0 | X |

*bal = balance

What is claimed is:

1. An aqueous hard surface detergent composition which provides improved solution feel comprising:

(1) 20–30% by weight of a surfactant system selected from the group consisting of anionic, nonionic, amphoteric surfactants, and mixtures thereof, comprising:

a. at least 35% by weight alkyl ethoxy sulfate with an alkyl group of C10–16 and an average of 2.5–3.5 moles of ethylene oxide per molecule;

b. diethanol amide with an alkyl chain of C8–20;

c. amine oxide with an alkyl chain of C8–16; and (2) 0.1–0.3% by weight calcium ion; and (3) 0.1 to 0.5% by weight magnesium ion;

wherein the composition contains 4–7% by weight the diethanol amide, and 2–5% by weight the amine oxide.

2. A method of cleaning a hard surface comprising contacting a hard surface with a cleaning effective amount of an aqueous hard surface detergent composition according to claim 1.

* * * * *